US008058543B2

(12) United States Patent
Han et al.

(10) Patent No.: US 8,058,543 B2
(45) Date of Patent: Nov. 15, 2011

(54) AUDIO SMOOTHING SYSTEM, DEVICE, AND METHOD

(75) Inventors: Jie-Cai Han, Nanjing (CN); Yi Sun, Nanjing (CN)

(73) Assignees: Inventec Appliances (Shanghai) Co. Ltd., Shanghai (CN); Inventec Appliances Corp., Taipei County (TW); Inventec Appliances Corp., Nanjing, Nanjing (CN)

( * ) Notice: Subject to any disclaimer, the term of this patent is extended or adjusted under 35 U.S.C. 154(b) by 39 days.

(21) Appl. No.: 12/813,538

(22) Filed: Jun. 11, 2010

(65) Prior Publication Data

US 2010/0313738 A1 Dec. 16, 2010

(30) Foreign Application Priority Data

Jun. 11, 2009 (CN) ..... 2009 1 0052899

(51) Int. Cl.
*G10H 7/00* (2006.01)

(52) U.S. Cl. ..... 84/604

(58) Field of Classification Search ..... 84/604
See application file for complete search history.

(56) References Cited

U.S. PATENT DOCUMENTS 4,114,498 A * 9/1978 Chibana et al. ..... 84/622
5,627,334 A * 5/1997 Hirano et al. ..... 84/623
6,169,240 B1 * 1/2001 Suzuki ..... 84/605
6,184,455 B1 * 2/2001 Tamura ..... 84/625
7,626,113 B2 * 12/2009 Kuroda ..... 84/659
7,908,134 B1 * 3/2011 Felber ..... 704/205
2010/0056198 A1 * 3/2010 Tachibana ..... 455/550.1
2011/0106209 A1 * 5/2011 Saoji ..... 607/57

FOREIGN PATENT DOCUMENTS

TW I305321 1/2009

* cited by examiner

*Primary Examiner* — Jianchun Qin

(74) *Attorney, Agent, or Firm* — WPAT, P.C.; Anthony King

(57) ABSTRACT

The present invention relates to an audio smoothing system for smoothing an audio waveform to generate a smoothed waveform, including an audio generator, an audio smoothing device and an operating interface. The audio smoothing device is provided for receiving an audio waveform of the audio generator to smooth a sound corresponding to the audio waveform, and the audio smoothing system includes a sound volume modulator, a waveform divider and a calculator. An audio smoothing method includes the steps of: dividing the audio waveform according to a predetermined cycle time while the audio waveform is received; calculating respectively average waveform amplitudes; after setting an input sound volume via the operating interface, dividing the input sound volume by amplitude values respectively to obtain amplitude parameters; and multiplying all the amplitude parameters with the amplitude values corresponding to the divided audio waveforms to obtain the smoothed waveform.

7 Claims, 5 Drawing Sheets

AUDIO SMOOTHING SYSTEM, DEVICE, AND METHOD

BACKGROUND OF THE INVENTION

1. Field of the Invention

The present invention relates to an audio system, device and method, and more particularly to a system, device and method for smoothing audio waveforms.

2. Description of Related Art

As science and technology advance rapidly, products with a music playing function are used extensively in our daily life. For example, handheld music players are usually used for listening to music and killing time while riding a bus or a mass rapid transit.

However, the sound volume of the playing music may vary with different amplitudes, and users have to adjust the sound volume manually, thereby causing inconvenience to the music appreciation. The range of the sound volume of a handheld music player is very narrow due to the cost concern of the hardware, so that a crushing sound effect may occur while playing music with a relatively high sound volume. It will be very convenient for users to play music, if the handheld music player comes with an automatic sound volume adjustment.

With reference to R.O.C. Pat. Publication No. I305321 entitled "A hearing protection system and method and a sound output device", a sound output device with a hearing protection function is disclosed. A sound volume exceeding a predetermined power volume will be lowered automatically by calculating an amplitude value, and a hearing protection signal or a visual protection signal is generated. However, it may scare a user when the hearing or visual protection signal appears suddenly. When the sound volume exceeding the predetermined power value, a higher music amplitude value will be disconnected directly so as to affect the user's fun of listening to the music.

Therefore, the inventor of the present invention developed an audio smoothing system and method to overcome the shortcomings of the prior art. The system and method are provided for smoothing a sound corresponding to an audio waveform to generate a smoothed waveform, such that the audio waveform is free of high and sharp amplitudes, and the higher music amplitude value is not cut off directly while appearing any higher music amplitude values, thereby maintaining the smoothness of the playing music.

SUMMARY OF THE INVENTION

In view of the prior art, the hearing protection system lowers the sound exceeding a predetermined sound volume automatically and generates the hearing protection signal or the visual protection signal suddenly which may scare a user. Moreover, the hearing protection system will disconnect the higher music amplitude value while the sound volume exceeds the maximum predetermined power value. Therefore, the primary object of the present invention is to provide an audio smoothing system for smoothing a sound corresponding to an audio waveform to generate a smoothed waveform.

For solving the problem in the prior art, a technical means in accordance with the present invention is to provide an audio smoothing system for smoothing an audio waveform to generate a smoothed waveform. The system comprises an audio generator, an audio smoothing device and an operating interface. The audio generator is used for generating the audio waveform. The audio smoothing device is electrically coupled to the audio generator for receiving the audio waveform and dividing the audio waveform according to a predetermine cycle time to form a plurality of adjacent waveform intervals comprising a first waveform interval, a second waveform interval and a third waveform interval.

An average waveform amplitude of the first waveform interval is a first average waveform amplitude, the average waveform amplitude of the first waveform interval is a second average waveform amplitude, and the average waveform amplitude of the first waveform interval is a third average waveform amplitude. Each of the waveform intervals is further divided into a front waveband, a middle waveband, and a rear waveband by the audio smoothing device.

The operating interface is electrically coupled to the audio smoothing device. An input sound volume can be set by a user and be transmitted to the audio smoothing device via the operating interface. Wherein, the input sound volume is divided by the first average waveform amplitude, the second average waveform amplitude, and the third average waveform amplitude by the audio smoothing device to generate correspondingly a first waveform parameter, a second waveform parameter and a third waveform parameter, respectively.

Further, the audio smoothing device calculates the average of the first waveform parameter and the second waveform parameter to obtain a front waveband parameter, and calculates the average of the second waveform parameter and the third waveform parameter to obtain a rear waveband parameter. The second waveform parameter is a middle waveband parameter. The front waveband parameter, middle waveband parameter and rear waveband parameter are multiplied respectively with the amplitude values of the front waveband, middle waveband, and rear waveband to obtain the smoothed waveform.

Compared to the hearing protection system in the prior art, the audio smoothing system of the present invention is to divide the audio waveform according to the predetermine cycle time and calculate the amplitude values of the audio waveform and corresponding parameters to generate the smoothed waveform. Consequently, the audio waveform can be formed into the smoothed waveform via the audio smoothing system. Obviously, the audio waveform in accordance with the present invention can be certainly formed into the smoothed waveform by calculating such that the music audio signal is smooth while the user is listening and there is no suddenly strong amplitude to make the user's ears hurt.

With these and other objects, advantages, and features of the invention that may become hereinafter apparent, the nature of the invention may be more clearly understood by reference to the detailed description of the invention, the embodiments and to the several drawings herein.

DETAILED DESCRIPTION OF THE PREFERRED EMBODIMENTS

Those of ordinary skilled in the art will realize that the following detailed description of the exemplary embodiments is illustrative only and is not intended to be in any way limiting. Other embodiments will readily suggest themselves to such skilled persons having the benefit of this disclosure. Reference will now be made in detail to implementations of the exemplary embodiments as illustrated in the accompanying drawings.

Figure 1:
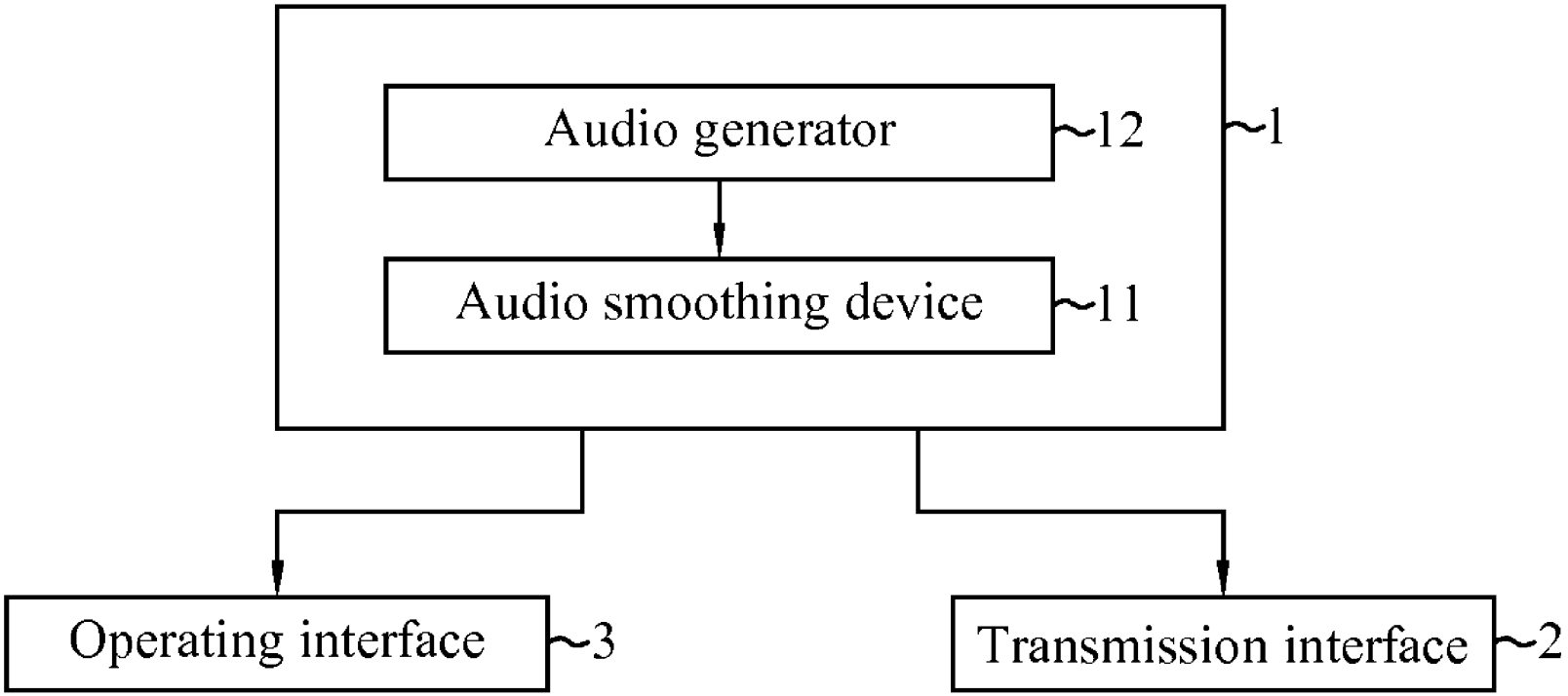
FIG. 1 illustrates a block schematic diagram of an audio smoothing system in accordance with the present invention.

Please refer to FIG. 1 illustrating a block schematic diagram of an audio smoothing system in accordance with the present invention. As shown in the figure, an audio smoothing system 1 comprises an audio smoothing device 11 and an audio generator 12. The audio smoothing device 11 is electrically coupled to the audio generator 12, and is further electrically coupled to an operating interface 3 and a transmission interface 2.

Figure 3:
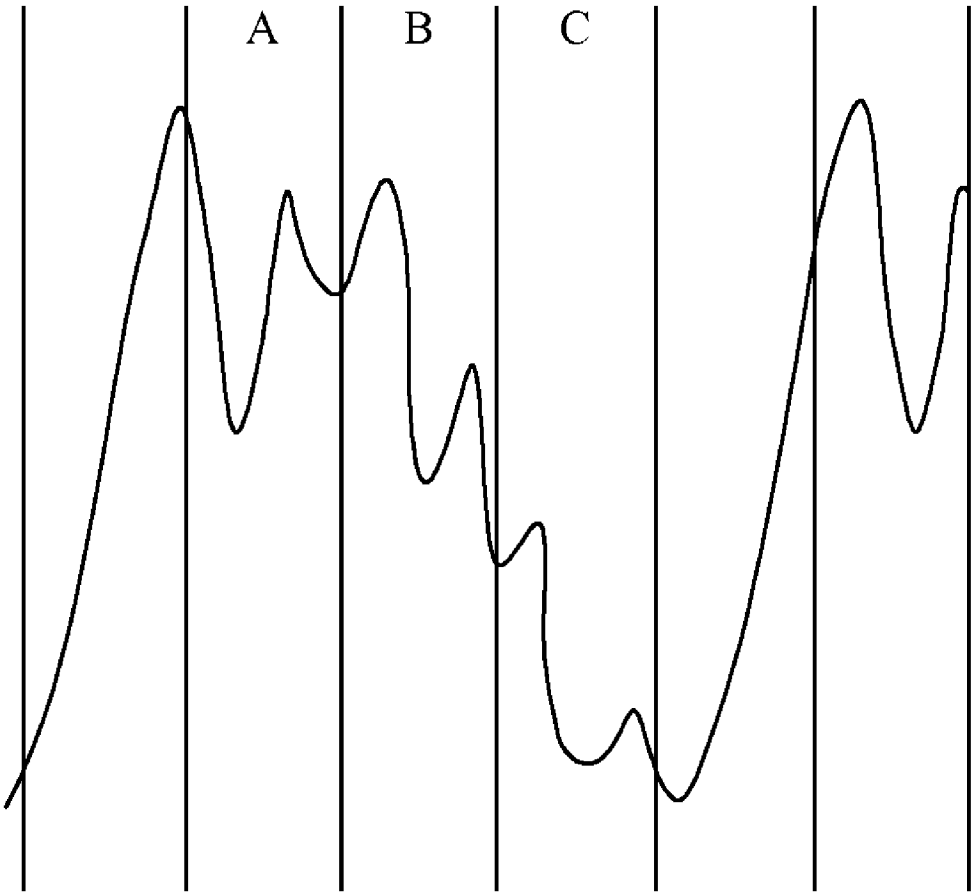
FIG. 3 illustrates a schematic diagram of an audio waveform divided by a predetermine cycle time in accordance with the present invention.
Figure 4:
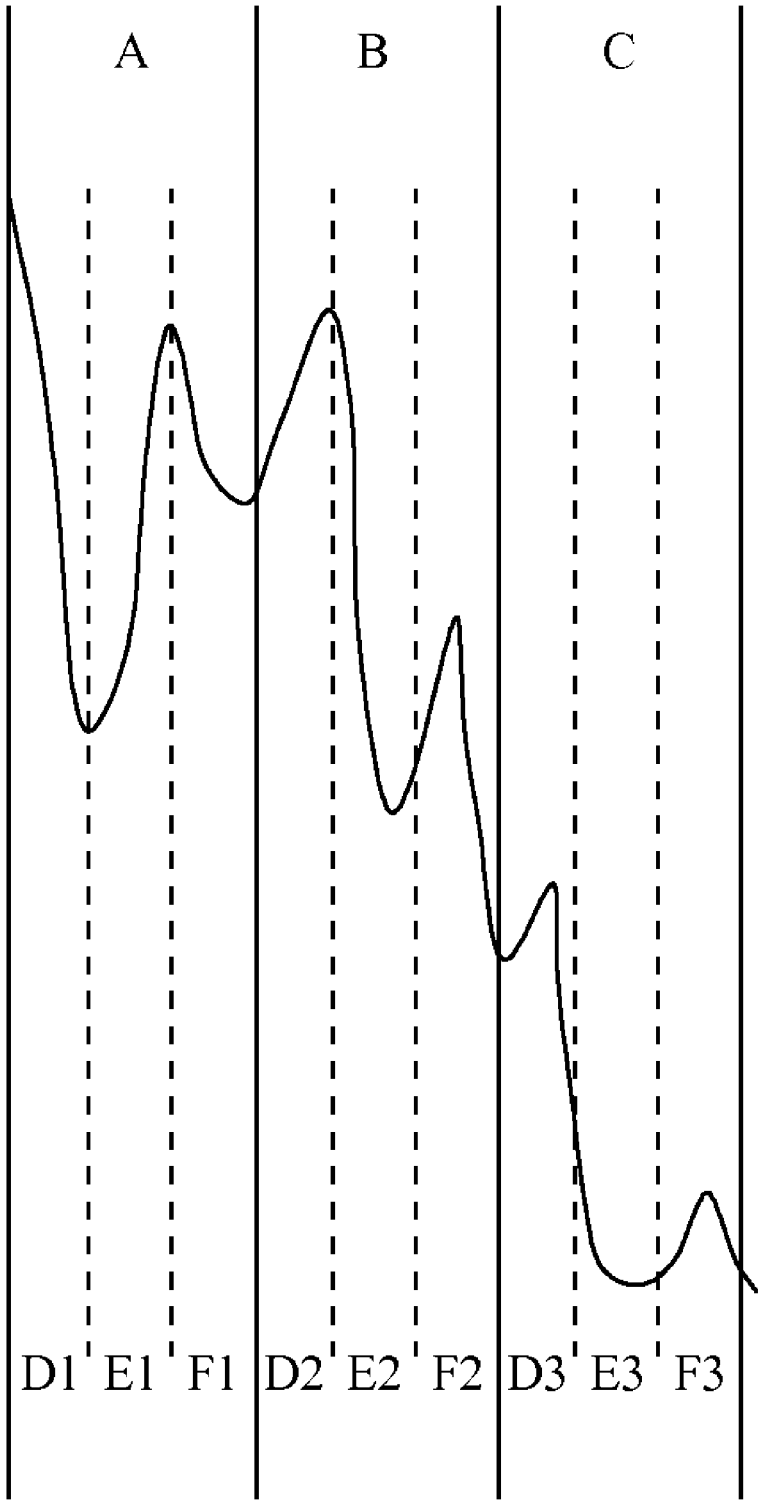
FIG. 4 illustrates a schematic diagram of waveform intervals further divided into a plurality of adjacent wavebands in accordance with the present invention.

Please also refer to FIGS. 3 and 4 while referring to FIG. 1. FIG. 3 shows that an audio waveform is divided according to a predetermine cycle time to form a plurality of adjacent waveform intervals, which are denoted as a first waveform interval A, a second waveform interval B and a third waveform interval C in this figure. FIG. 4 illustrates a schematic diagram of each of the waveform intervals further divided into a front waveband, a middle waveband and a rear waveband adjacently.

Figure 2:
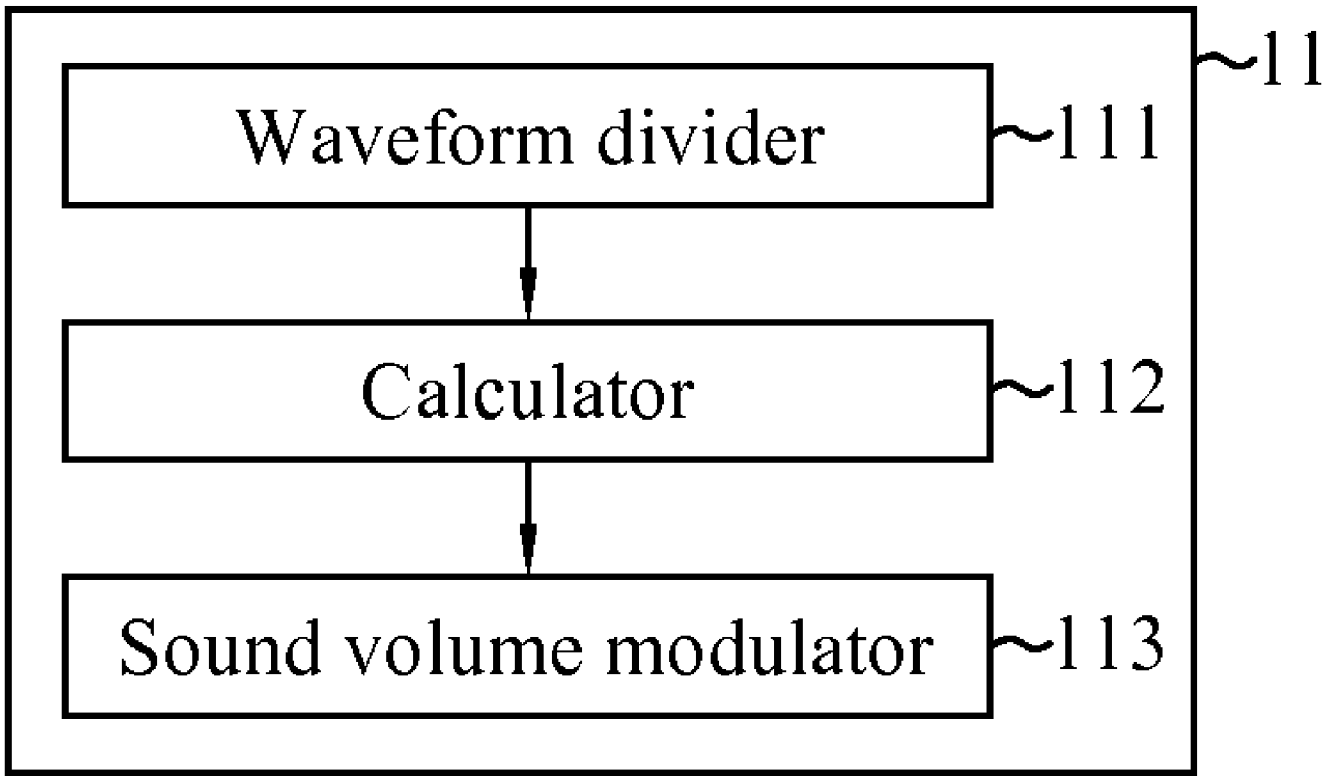
FIG. 2 illustrates a block schematic diagram of an audio smoothing device in accordance with the present invention.

Please refer to FIG. 2 illustrating a block schematic diagram of an audio smoothing device in accordance with the present invention. As shown in the figure, an audio smoothing device 11 comprises a sound volume modulator 113, a waveform divider 111 and a calculator 112. The calculator 112 is electrically coupled to the waveform divider 111 and the sound volume modulator 113, respectively.

The audio generator 12 is used for generating and outputting the audio waveform. After the audio waveform is received by the audio smoothing device 11, the audio waveform is divided according to the predetermine cycle time by the waveform divider 111. The audio waveform is divided into a plurality of waveform intervals. In this embodiment, the audio waveform is divided into three waveform intervals comprising the first waveform interval A, the second waveform interval B and the third waveform interval C adjacently for taking as an example. The second waveform interval B is further divided into a front waveband D2, a middle waveband E2 and a rear waveband F2 by the waveform divider 111. Similarly, the first waveform interval A is divided into a front waveband D1, a middle waveband E1 and a rear waveband F1, and the third waveform interval C is divided into a front waveband D3, a middle waveband E3 and a rear waveband F3. Wherein, the waveform interval can be divided into the front waveband, the middle waveband and the rear waveband according to time, proportion or equipartition as the basis of division.

A user can use the operating interface 3 to generate and transmit input sound volume to the audio smoothing device 11.

After being divided by the waveform divider 111, the audio waveform is transmitted to the calculator 112 for calculating average waveform amplitudes of the first waveform interval A, the second waveform interval B and the third waveform interval C, respectively. The average waveform amplitude of the first waveform interval A is a first average waveform amplitude, and the average waveform amplitude of the second waveform interval B is a second average waveform amplitude, and the average waveform amplitude of the third waveform interval C is a third average waveform amplitude.

The input sound volume is divided by the first average waveform amplitude, the second average waveform amplitude and the third average waveform amplitude to generate respectively a first waveform parameter, a second waveform parameter and a third waveform parameter by the calculator 112. Next, the average of the first waveform parameter and the second waveform parameter is calculated to obtain a front waveband parameter, wherein the second waveform parameter is a middle waveband parameter, and the average of the second waveform parameter and the third waveform parameter is a rear waveband parameter.

For the initial audio waveform, the divided first waveform interval has no preceding adjacent waveform interval, and the terminal waveform interval has no succeeding adjacent waveform interval. Thus, how to smooth the initial waveform interval and terminal waveform interval of the audio waveform will be demonstrated as follows.

The waveform intervals are obtained by using waveform divider 111. Wherein, the divided first waveform interval having no preceding adjacent waveform interval is the initial waveform interval, and the terminal waveform interval having no succeeding adjacent waveform interval is the terminal waveform interval. The initial waveform interval is divided into an initial front waveband and an initial rear waveband, and the terminal waveform interval is divided into a terminal front waveband and a terminal rear waveband. Subsequently, the input sound volume is divided respectively by the average waveform amplitudes of the initial waveform interval and the terminal waveform internal by the calculator 112 to obtain an initial waveform parameter and a terminal waveform parameter, respectively.

Further, the initial waveform parameter is equivalent to an initial front waveband parameter, and the terminal waveform parameter is equivalent to a terminal rear waveband parameter. Furthermore, the calculator 112 calculates the average of the initial waveform parameter and the waveform parameter of an adjacent waveform interval succeeding to the initial waveform interval to obtain an initial rear waveband parameter, and calculates the average of the terminal waveform parameter and the waveform parameter of an adjacent waveform interval preceding to the terminal waveform interval to obtain a terminal front waveband parameter.

Please refer to FIG. 4. The audio waveform is a continuous waveform and thus can be resolved into a plurality of amplitude values. Thus, after the audio waveform is divided into wavebands, each waveband can be also resolved into a plurality of amplitude values. The front waveband parameter, the middle waveband parameter, and the rear waveband parameter are multiplied respectively with the amplitude values corresponding to the audio waveforms of the front waveband D2, the middle waveband E2 and the rear waveband F2 of the second waveform interval B. The rear waveband parameter of the rear waveband F1 is equal to the front waveband parameter of the front waveband D2 because both are the average of the first waveform parameter and the second waveform parameter. The parameter values multiplied by the audio waveforms of the rear waveband F1 and the front waveband D2 are the same, thereby obtaining a continuous smoothed waveform. The audio smoothing system 1 will transmit the smoothened waveform to a speaker device which is out of the audio smoothening system via the transmission interface 3.

Finally, in order to spread the technique of the present invention, a simple flowchart is provided by compiling the above-mentioned techniques such that the skilled in the art can remember more easily.

Figure 5:
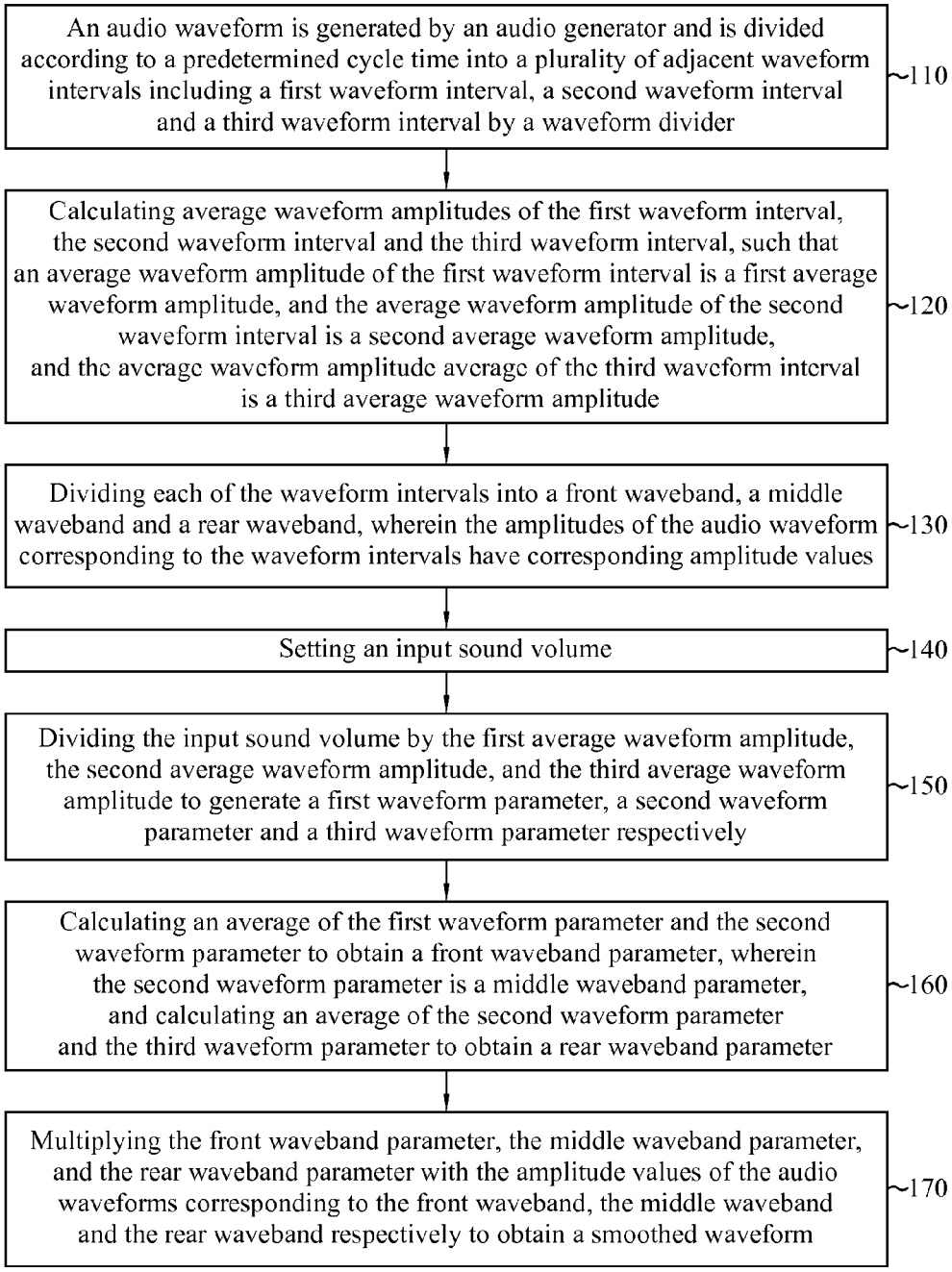
FIG. 5 illustrates a simple flowchart in accordance with a preferred embodiment of the present invention.

Please refer to FIG. 5 showing a simple flowchart in accordance with a preferred embodiment of the present invention. In step 110, an audio waveform is generated by an audio generator and is divided according to a predetermined cycle time into a plurality of adjacent waveform intervals including a first waveform interval, a second waveform interval and a third waveform interval by a waveform divider.

In step 120, average waveform amplitudes of the first waveform interval, the second waveform interval and the third waveform interval are calculated respectively, wherein an average waveform amplitude of the first waveform interval is a first average waveform amplitude, and the average waveform amplitude of the second waveform interval is a second average waveform amplitude, and the average waveform amplitude average of a third waveform interval is the third average waveform amplitude.

In step 130, each of the waveform intervals is divided into a front waveband, a middle waveband and a rear waveband, wherein the amplitudes of the audio waveform corresponding to the waveform intervals have corresponding amplitude values.

In step 140, an input sound volume is set.

In step 150, the input sound volume is divided by the first average waveform amplitude, the second average waveform amplitude, and the third average waveform amplitude to generate a first waveform parameter, a second waveform parameter and a third waveform parameter, respectively.

In step 160, an average of the first waveform parameter and the second waveform parameter is calculated to obtain a front waveband parameter, wherein the second waveform parameter is a middle waveband parameter, and an average of the second waveform parameter and the third waveform parameter is calculated to obtain a rear waveband parameter.

In step 170, the front waveband parameter, the middle waveband parameter and the rear waveband parameter are respectively multiplied with the amplitude values of the audio waveforms corresponding to the front waveband, the middle waveband and the rear waveband to obtain a smoothed waveform.

While particular embodiments of the present invention have been shown and described, it will be obvious to those skilled in the art that, based upon the teachings herein, changes and modifications may be made without departing from this invention and its broader aspects. Therefore, the appended claims are intended to encompass within their scope of all such changes and modifications as are within the true spirit and scope of the exemplary embodiments of the present invention.

What is claimed is:

1. An audio smoothing system for smoothing an audio waveform to generate a smoothed waveform, comprising:

an audio generator for generating the audio waveform;

audio smoothing device electrically coupled to the audio generator for receiving the audio waveform and dividing the audio waveform according to a predetermine cycle time to form a plurality of adjacent waveform intervals, and each of the waveform intervals having a corresponding average waveform amplitude, wherein the waveform interval is further divided into a plurality of wavebands including a front waveband, a middle waveband, and a rear waveband, and the wavebands have a front waveband parameter, a middle waveband parameter, and a rear waveband parameter respectively; and an operating interface electrically coupled to the audio smoothing device for generating and transmitting an input sound volume to the audio smoothing device;

wherein the audio smoothing device divides the input sound volume by the average waveform amplitudes respectively to obtain a plurality of waveform parameters, and further sets the front waveband parameter of the waveform interval equal to an average of the waveform parameter of an adjacent waveform interval preceding to the waveform interval and the waveform parameter of the waveform interval, and sets the middle waveband parameter of the waveform interval equal to the waveform parameter of the waveform interval, and sets the rear waveband parameter of the waveform interval equal to an average of the waveform parameter of an adjacent waveform interval succeeding to the waveform interval and the waveform parameter of the waveform interval, and then the audio smoothing device multiplies the waveform parameters with the waveband amplitude values respectively to obtain the smoothed waveform.

2. The audio smoothing system of claim 1, wherein the waveform interval further comprises an initial waveform interval and a terminal waveform interval, and the initial waveform interval has no preceding adjacent waveform interval, and the terminal waveform interval has no succeeding adjacent waveform interval, and the audio smoothing device divides the initial waveform interval into an initial front waveband and an initial rear waveband, and the audio smoothing device divides the terminal waveform interval into a terminal front waveband and a terminal rear waveband, and the audio smoothing device divides the input sound volume by the average waveform amplitudes of the initial waveform interval and the terminal waveform internal to obtain an initial waveform parameter and a terminal waveform parameter respectively, wherein the initial front waveband, the initial rear waveband, the terminal front waveband and the terminal rear waveband correspond to an initial front waveband parameter, an initial rear waveband parameter, a terminal front waveband parameter, and a terminal rear waveband parameter respectively, and the initial front waveband parameter is the initial front waveform parameter, and the initial rear waveband parameter is equal to an average of the initial waveform parameter and the waveform parameter of an adjacent waveform interval succeeding to the initial waveform interval, and the terminal front waveband parameter is equal to an average of the terminal waveform parameter and the waveform parameter of an adjacent waveform interval preceding to the terminal waveform interval, and the terminal waveband parameter is the terminal waveform parameter.

3. The audio smoothing system of claim 1, being electrically coupled to a transmission interface for transmitting the smoothened waveform out of the audio smoothening system.

4. The audio smoothening system of claim 1, wherein the audio smoothing device comprises:

a waveform divider for dividing the audio waveform according to the predetermined cycle time to form the plurality of adjacent waveform intervals and further dividing each of the waveform intervals into the front waveband, the middle waveband and the rear waveband;

a calculator electrically coupled to the waveform divider for calculating the average waveform amplitude of each the waveform interval and dividing the input sound volume by the average waveform amplitudes to obtain the waveform parameters, and calculating the plurality of waveband parameters; and a sound volume modulator electrically coupled to the calculator for obtaining the waveband parameters and adjusting the audio waveform amplitude value according to the waveband parameters to form the smoothed waveform.

5. An audio smoothing device for receiving an audio waveform and processing the audio waveform to smooth a sound corresponding to the audio waveform, and the audio smoothing system comprising:

a waveform divider for dividing the audio waveform according to a predetermined cycle time to form a plurality of adjacent waveform intervals and further dividing each of the waveform intervals into a front waveband, a middle waveband and a rear waveband;

a calculator electrically coupled to the waveform divider for calculating an average waveform amplitude of each the waveform interval and dividing an input sound volume by the average waveform amplitude to obtain a waveform parameter, and calculating an average of the waveform parameters to obtain a plurality of waveband parameters; and a sound volume modulator electrically coupled to the calculator for obtaining the waveband parameters and adjusting each audio waveform amplitude value according to the waveband parameters to form a smoothed waveform.

6. The audio smoothing device of claim 5, wherein the sound volume is inputted to the audio smoothing system through an operating interface.

7. An audio smoothing method for receiving an audio waveform and processing a sound corresponding to the audio waveform to generate a smoothed waveform, and the audio smoothing method comprising steps of:

(a) dividing the audio waveform into a plurality of adjacent waveform intervals according to a predetermined cycle time, and the waveform intervals including a first waveform interval, a second waveform interval, and a third waveform interval;

(b) calculating average waveform amplitudes for the first waveform interval, the second waveform interval, and the third waveform interval, such that the average waveform amplitude of the first waveform interval is a first average waveform amplitude, and the average waveform amplitude of the second waveform interval is a second average waveform amplitude, and the average waveform amplitude of the third waveform interval is a third average waveform amplitude;

(c) dividing the waveform intervals into a front waveband, a middle waveband, and a rear waveband, and the audio waveforms corresponding to the front waveband, the middle waveband, and the rear waveband having corresponding amplitude values;

(d) setting an input sound volume;

(e) dividing the input sound volume by the first average waveform amplitude, the second average waveform amplitude, and the third average waveform amplitude to generate respectively a first waveform parameter, a second waveform parameter and a third waveform parameter;

(f) calculating an average of the first waveform parameter and the second waveform parameter to obtain a front waveband parameter, and the second waveform parameter being the middle waveband parameter, and calculating the second waveform parameter and the third waveform parameter to obtain a rear waveband parameter; and (g) multiplying the front waveband parameter, the middle waveband parameter, and the rear waveband parameter with the amplitude values of the audio waveforms corresponding to the front waveband, the middle waveband and the rear waveband respectively to obtain the smoothed waveform.

* * * * *